US010755880B2

(12) United States Patent
Hofsaess

(10) Patent No.: US 10,755,880 B2
(45) Date of Patent: Aug. 25, 2020

(54) TEMPERATURE-DEPENDENT SWITCH WITH CUTTING BURR

(71) Applicant: Marcel P. Hofsaess, Kyffhäuserland (DE)

(72) Inventor: Marcel P. Hofsaess, Kyffhäuserland (DE)

( * ) Notice: Subject to any disclaimer, the term of this patent is extended or adjusted under 35 U.S.C. 154(b) by 0 days.

(21) Appl. No.: 16/161,538

(22) Filed: Oct. 16, 2018

(65) Prior Publication Data

US 2019/0051477 A1 Feb. 14, 2019

Related U.S. Application Data

(62) Division of application No. 15/240,007, filed on Aug. 18, 2016.

(30) Foreign Application Priority Data

Aug. 27, 2015 (DE) ..... 10 2015 114 248

(51) Int. Cl.
*H01H 37/04* (2006.01)
*H01H 37/54* (2006.01)
*H01H 37/64* (2006.01)

(52) U.S. Cl.
CPC ..... *H01H 37/04* (2013.01); *H01H 37/54* (2013.01); *H01H 37/64* (2013.01); *H01H 37/5427* (2013.01); *H01H 2223/002* (2013.01)

(58) Field of Classification Search
CPC ..... H01H 37/04; H01H 37/64; H01H 37/54; H01H 2223/002; H01H 37/5427
(Continued)

(56) References Cited

U.S. PATENT DOCUMENTS 3,768,057 A * 10/1973 Sekira ..... H01H 37/54 337/349
4,119,234 A * 10/1978 Kotschak ..... H01J 5/18 220/2.1 R
(Continued)

FOREIGN PATENT DOCUMENTS

CN 104037017 A 9/2014
DE 19517310 A1 11/1996
(Continued)

OTHER PUBLICATIONS

Hofsaess, Marcel, "Temperature depending switch whose mechanism is enclosed in housing with cover lid, with two stationary contacts, each coupled to allocated outer terminal, with switch mechanism current transmitter connecting stationary contacts temperature", Oct. 13, 2005, Entire Document. (Year: 2005).*
(Continued)

*Primary Examiner* — Jayprakash N Gandhi
*Assistant Examiner* — Stephen S Sul
(74) *Attorney, Agent, or Firm* — Harness, Dickey & Pierce, P.L.C.

(57) ABSTRACT

A temperature-dependent switch has a housing with a cover part having a lower side and an upper side and with an electrically conductive lower part having a circumferential shoulder and a circumferential wall with an upper section that overlaps the cover part. The switch has a first external contact surface on the upper side of the cover part and a second external contact surface externally on the housing, wherein the upper section of the circumferential wall presses the cover part onto the circumferential shoulder. A temperature-dependent switching mechanism is arranged in the housing and, depending on its temperature, establishes or opens an electrically conductive connection between the first
(Continued)

and second external contact surfaces. A circumferential cutting burr is arranged on the shoulder in the lower part.

16 Claims, 3 Drawing Sheets

(58) Field of Classification Search
USPC ..... 337/16, 27, 85, 89, 298, 333, 343, 362, 337/365, 380; 361/103, 105
See application file for complete search history.

(56) References Cited

U.S. PATENT DOCUMENTS 4,470,033 A * 9/1984 Hofsass ..... H01H 37/5427 337/343
4,643,512 A * 2/1987 Prodel ..... H01R 9/03 439/412
5,615,072 A * 3/1997 Hofsass ..... H01H 1/504 337/107
5,670,930 A 9/1997 Hofsass et al.
5,867,085 A * 2/1999 Kruck ..... H01H 11/0056 337/333
5,877,671 A 3/1999 Hofsass
5,903,210 A * 5/1999 Hofsass ..... H01H 37/64 337/333
5,973,587 A * 10/1999 Hofsass ..... H01H 1/504 337/333
6,100,784 A 8/2000 Hofsass
6,210,824 B1 4/2001 Sullivan et al.
6,249,211 B1 6/2001 Hofsaess
6,707,372 B2 * 3/2004 Davis ..... G08B 13/1681 337/300
8,536,972 B2 9/2013 Hofsaess
8,847,725 B2 * 9/2014 Buettner ..... H01H 37/5427 337/298
2003/0171041 A1 * 9/2003 Blaha ..... H01R 4/4809 439/787
2009/0045805 A1 * 2/2009 Worones ..... H05K 5/061 324/156
2011/0050385 A1 3/2011 Hofsaess
2013/0127586 A1 * 5/2013 Hofsaess ..... H01H 37/54 337/365
2013/0271258 A1 10/2013 Hofsaess et al.
2014/0168844 A1 6/2014 Liehr et al.
2014/0178661 A1 * 6/2014 Adjei ..... D21H 17/72 428/220
2014/0320257 A1 10/2014 Hofsaess
2015/0028433 A1 1/2015 Baillin et al.
2015/0061818 A1 3/2015 Klaschewski et al.
2016/0027598 A1 1/2016 Neumann

FOREIGN PATENT DOCUMENTS

DE 4345350 C2 5/1997
DE 19623570 A1 1/1998
DE 19827113 C2 11/2001
DE 4143671 C2 2/2002
DE 102004015394 A1 * 10/2005 ..... H01H 1/504
DE 102009039948 A1 3/2011
DE 102011119637 A1 5/2013
DE 102013102089 B4 2/2015
DE 102013102006 B4 3/2015
EP 0651411 A1 5/1995
EP 0813215 A1 12/1997

OTHER PUBLICATIONS

European Search Report for EP 16181935; dated Jan. 13, 2017; 9 pp.

* cited by examiner

TEMPERATURE-DEPENDENT SWITCH WITH CUTTING BURR

CROSS REFERENCE TO RELATED APPLICATIONS

This application is a divisional application of the parent U.S. application Ser. No. 15/240,007 filed on Aug. 18, 2016, which parent US application claims priority of German patent application DE 10 2015 114 248, filed on Aug. 27, 2015 and published in German. The content of the parent US application as well as the content of the German priority application are incorporated herein by reference.

FIELD OF THE INVENTION

The disclosure relates to a temperature-dependent switch with a housing that comprises a cover part with a lower side and an upper side as well as an electrically conductive lower part with a circumferential shoulder and a circumferential wall, whose upper section overlaps the cover part, with at least a first external contact surface arranged on the upper side of the cover part, at least a second external contact surface provided externally on the housing, wherein the upper section of the circumferential wall of the lower part that overlaps the cover part presses the cover part onto the circumferential shoulder, and with a temperature-dependent switching mechanism arranged in the housing which, depending on its temperature, establishes or opens an electrically conductive connection between the first and second external contact surfaces, wherein a sealing means is provided between the cover part and the lower part.

BACKGROUND OF THE INVENTION

An exemplary temperature-dependent switch is known from DE 196 23 570 A1.

The known temperature-dependent switch is used, in a manner known per se, to monitor the temperature of a device. For that purpose it is, for example, brought into thermal contact through its external surfaces with the device to be protected, so that the temperature of the device to be protected affects the temperature of the switching mechanism.

The switch is connected electrically in series in the power supply circuit of the device to be protected by means of connecting wires soldered to its two external contact surfaces so that the supply current to the device to be protected flows through the switch when below the response temperature of the switch.

The known switch comprises a deep-drawn or turned lower part, in which an internal, circumferential shoulder is provided, on which a cover part rests. The cover part is held firmly against this shoulder through a circumferential raised wall of the lower part, whose upper section is folded radially inwards.

Since the cover part and the lower part are made of electrically conductive material, an insulating foil is provided between them, running around the cover part, extending inside the switch parallel to the cover part, and drawn up at the side, so that its edge region extends up to the upper side of the cover part. The folded upper section of the circumferential wall of the lower part thus lies on the edge region of the insulating foil.

The temperature-dependent switching mechanism here comprises a snap-action spring disk that carries a movable contact part, along with a bimetal disk put over the movable contact part. The snap-action spring disk presses the movable contact part against a stationary counter-contact inside on the cover part.

The snap-action spring disk is supported by its edge in the lower part of the housing, so that the electrical current flows from the lower part through the snap-action spring disk and the movable contact part into the stationary counter-contact, and from there into the cover part.

A first external contact surface, which is arranged in the center on the cover part, acts as a first external connection. A second external contact surface provided on the folded wall of the lower part acts as the second external connection. It is also, however, possible for the second external connection not to be arranged at this edge, but at the side on the current-carrying housing or on the lower side of the lower part.

Attaching a current transfer member on the snap-action spring disk in the form of a contact bridge that is pressed by the snap-action spring disk against two stationary counter-contacts provided on the lower side of the cover part is known from DE 198 27 113 C2. In this case the second external contact surface is also arranged on the upper side of the cover part. The two counter-contacts are connected via the cover part with the two external contact surfaces. The current then flows from one external contact surface, via the associated counter-contact, through the contact bridge into the other stationary counter-contact, and from there to the other external contact surface, so that the operating current does not flow through the snap-action spring disk itself.

This design is in particular chosen when very high currents that no longer can be carried without problem through the spring disk itself have to be switched.

In both design variants, a bimetal disk, which lies force-free in the switching mechanism when below its critical temperature, is provided for the temperature-dependent switching function.

In the context of the present invention, a bimetal part refers to a multilayer, active, sheet-like component of two, three or four inseparably bonded components with different coefficients of expansion. The joins between the individual layers of metal or metal alloy are materially bonded or form-fitted, and are, for example, fabricated by rolling.

Bimetal parts of this kind have a first stable geometric configuration in their low-temperature position, and a second one in their high-temperature position, between which they jump, depending on the temperature, in a hysteresis-like manner. When the temperature changes above their response temperature or below their return temperature, the bimetal parts snap into the respectively other configuration. The bimetal parts are therefore often referred to as snap-action disks, and when seen from above can be elongated, oval or circular in form.

If, as a result of a rise in temperature in the device to be protected, the temperature of the bimetal disk now rises above the response temperature, the bimetal disk changes its configuration, and so acts against the snap-action spring disk in such a way that the movable contact part is lifted off the stationary counter-contact or the current-transfer member is lifted off the two stationary counter-contacts, so that the switch opens and the device to be protected is switched off and can no longer heat up.

In these designs, the bimetal disk is held without mechanical force when under its response temperature, and the bimetal disk thus also is not used to carry the current.

It is advantageous here that the bimetal disks exhibit a long mechanical service life, and that the switching point, that is the response temperature of the bimetal disks, also does not change even after a large number of switching operations.

When the requirements for the mechanical reliability and/or the stability of the response temperature are lower, the bimetal snap-action disk can also perform the function of the snap-action spring disk and, potentially, also of the current transfer member, so that the switching mechanism only comprises one bimetal disk, which then carries the movable contact part or comprises two contact surfaces instead of the current transfer member, so that the bimetal disk not only provides the closing pressure of the switch, but also, carries the current when the switch is in the closed state.

The provision of a parallel resistor, connected in parallel with the external terminals, to switches of this type is furthermore known. When the switch is opened, this parallel resistor takes part of the operating current, and holds the switch at a temperature above the response temperature, so that the switch does not automatically close again after cooling down. Switches of this sort are known as self-holding.

Fitting a series resistor, through which the operating current flowing through the switch passes, to switches of this type is furthermore known. In this way, an ohmic heat, proportional to the square of the current flowing, is generated in the series resistor. If the magnitude of the current exceeds a permitted size, the heat of the series resistor has the result that the switching mechanism is opened.

In this way, a device to be protected is already disconnected from its power supply circuit when an excessively high flow of current that has not yet resulted in excessive heating of the device is noted.

Instead of a usually circular bimetal disk, it is also possible to use a bimetal spring clamped at one end and supporting a movable contact part or contact bridge.

It is also, however, possible to use temperature-dependent switches which, as current transmission members, do not comprise a contact plate but rather a spring part which carries the two counter-contacts, or on which the two counter-contacts are formed. The spring part can be a bimetal part, in particular a bimetal snap-action disk, which not only implements the temperature-dependent switching function, but at the same time also provides the contact pressure and carries the current when the switch is closed.

All these different design variants can be implemented with the switch according to the invention; in particular the bimetal disk can perform the function of the snap-action spring disk.

A temperature-dependent switch, with a comparable construction to that of DE 196 23 570 A1 referred to above is known from DE 195 17 310 A1, in which the cover part, however, is made of a positive temperature coefficient thermistor material, and which can lie on a circumferential shoulder in the inside of the lower part without a layer of insulating foil being placed between them, against which it is pressed by the upper section of the circumferential wall of the lower part which is folded radially towards the inside.

In this way the positive temperature coefficient cover is connected in parallel with the two external terminals, so that it provides the switch with a self-holding function.

Positive temperature coefficient thermistors of this type are also known as PTC resistors. They are made, for example from semiconducting, polycrystalline ceramics such as $BaTiO_3$.

The cover part of the temperature-dependent switch with contact bridge known from DE 198 27 113 C2 referred to above is again made of positive temperature coefficient material, so that it also exhibits a self-holding function. Two rivets are arranged here on the cover part whose heads, lying on the outside, form the two external terminals, and whose heads on the inside interact as stationary counter-contacts with the contact bridge.

In a switch with this type of construction, the cover part can also be made of insulating material or of metal, where in the latter case, as in the switch known from DE 196 23 570 A1, an insulating foil is provided, running around the cover part and extending within the switch parallel to the cover part and pulled upwards at the sides, so that its edge region extends up to the upper side of the cover part. The upper section of the circumferential wall of the lower part, which is folded radially inwards, here presses, with the insulating foil in between, onto the cover part.

In the known switches, the housing is usually protected against the ingress of contamination by a seal, which is applied before or after joining the connecting lugs or connecting cables to the external terminals.

Molding the external terminals with a single-component thermosetting plastic is known from DE 41 43 671 A1. Casting the connecting lugs with an epoxy resin is known from DE 10 2009 039 948. It is also known that an impregnating varnish or protective varnish is frequently applied to the known switches after soldering to the connecting cables or connecting lugs.

To prevent the varnish penetrating here into the inside of the housing, the cover part of the switch known from DE 196 23 570 A1 referred to at the outset is provided with a sealing means in the form of a circumferential bead which runs radially outside on the lower side of the cover part, and with which, when the upper section of the circumferential wall of the lower part is folded, the insulating foil is constricted. While this does provide better sealing, in many cases varnish nevertheless does penetrate into the inside of the housing.

In the comparable switches known from DE 196 23 570 A1 mentioned at the outset, the insulating foil lying between the lower part and the cover part is pulled up to the side between the wall of the lower part and the cover part, and its edge region is turned up onto the upper side of the cover part. The stiff insulating foil becomes rippled by the turning over, and forms rosettes which cannot be reliably sealed by the upper section of the circumferential wall of the lower part that is pressed flat onto them. There is, moreover, a risk that the finishing varnish penetrates inside the switch through the rosettes. DE 196 23 570 A1 attempts to reduce this problem through the bead that has already been mentioned.

DE 10 2013 102 089 B4 describes a switch which, in principle, is known from DE 196 23 570 A1 explained above. This switch comprises a spacing ring between the shoulder in the lower part and the cover part, which permits a larger contact gap between the movable contact part and the stationary counter-contact. To overcome the known sealing problem with the switch described in DE 196 23 570 A1, the edge region of the insulating sheet in this switch is given V-shaped incisions from the outside, whereby the ripple is greatly reduced, so improving the sealing.

DE 10 2013 102 006 B4 also describes a switch, as is known in principle from DE 196 23 570 A1 explained above. This switch, like the switch known from DE 195 17 310 A1 comprises a cover part of positive temperature coefficient material. Due to the poor resistance to compression of this PTC cover, the upper section, folded radially inwards, of the circumferential wall of the lower part cannot provide sufficient sealing in the known switch against the ingress of contamination, for which reason the folded upper section of the circumferential wall in the switch known from DE 195 17 310 A1 must be sealed against the upper side of the cover part with silicone, which leads frequently to problems.

DE 10 2013 102 006 B4 solves this problem in that a covering foil is provided which only lies on the upper side of the PTC cover, and into which the upper section of the circumferential wall of the lower part which is folded and lies flat against the covering foil, penetrates. The front side of the upper section of the circumferential wall faces away from the covering foil. The upper section of the circumferential wall of the lower part, which is lying flat, however frequently does not provide the desired sealing.

A covering foil and an insulating foil can also be provided to a switch, as is illustrated, for example, by DE 10 2013 102 089 B4. An insulating covering foil, for example made of Nomex®, is arranged on the upper side of the cover part of this switch, extending with its edge radially outwards as far as the insulating foil, which consists, for example, of Kapton®. Nomex® and Kapton® consist of aramid paper and of aromatic polyimides, respectively.

In spite of the various sealing measures, sealing problems continue to occur with the known switches, due in part to the fact that, as a result of the bending of the upper section of the circumferential edge of the lower part, the relatively stiff insulating foils cannot achieve a lasting seal. In addition, the cost of the construction that is necessary in order to achieve good sealing is high.

SUMMARY OF THE INVENTION

It is an object to overcome, at least to reduce, the problems explained above with the known switches in a constructively simple and economical manner.

According to an aspect, a temperature-dependent switch is presented, which comprises:

a housing comprising an electrically conductive lower part and a cover part made of an electrically insulating material, said cover part being provided with a lower side and an upper side, said lower part being provided with a circumferential shoulder and a circumferential wall, wherein said cover part lies with its lower side on said circumferential shoulder, and wherein said circumferential wall of said lower part has an upper section overlapping said cover part and pressing said cover part onto said circumferential shoulder, at least one first external contact surface being arranged on said upper side of said cover part, at least one second external contact surface being provided externally on said housing, a temperature-dependent switching mechanism being arranged in said housing, which switching mechanism, depending on its temperature, establishes or opens an electrically conductive connection between said at least one first and said at least one second external contact surfaces, and a first cutting burr being arranged on said circumferential shoulder in said lower part, said first cutting burr forming a mechanical barrier between said cover part and said lower part by said first cutting burr penetrating into said lower side of said cover part.

During assembly of the new switch, the first cutting burr, which preferably has a closed perimeter, penetrates into the lower side of the cover part, and thus ensures secure sealing between the circumferential shoulder on the inside of the lower part and the cover part. The first cutting burr can take the form of a bead, but preferably has a triangle-like cross-section, wherein its shape is adjusted to the material into which it penetrates during assembly of the new switch.

The first cutting burr is preferably created along with the manufacture of the lower part, and is preferably formed integrally with the shoulder. The cutting burr can be created during the deep drawing, stamping or turning of the lower part.

A seal is thus created by the first cutting burr acting between the shoulder of the lower part and the cover part, which seal acts through penetration of the cutting burr into the cover part that lies above it, so that the first cutting burr presents a mechanical barrier. The sealing effect is thus achieved through a structural element that presents a mechanical obstacle to incoming contamination, thus reliably holding back both particles and liquids.

The inventor of the present application has recognized that the problems with the sealing of the known switches can be traced back to the fact that during the bending over the upper side of the cover part, the insulating foil becomes rippled or folded. The result of this is that creep paths for liquids arise not only—as has been assumed till now—between the insulating foil and the cover part, but in the first place between the insulating foil and the circumferential wall of the lower part, so that when the known switch is impregnated with protective varnishes, these can creep into the interior of the switch on both sides of the insulating foil.

The folded wall of the lower part of prior art switches also does not seal the upper side against other electrical insulating materials sufficiently well to ensure in every case that no liquid can penetrate inside the switch during the resin treatment.

Also when soldering connecting cables to the upper side of prior art switches, or to the contact surfaces provided there, the possibility that solder or associated liquids will reach the inside of the switch cannot be entirely ruled out.

In that, according to this disclosure, the first cutting burr penetrates into the cover part, there is now a mechanical barrier to contamination.

According to a refinement, the first cutting burr is circumferentially closed in itself, this resulting in an even better sealing effect, since a closed seal in the shape of an annular barrier is created when the new switch is assembled.

Since the cover part preferably consist of electrically insulating material, an insulating foil arranged between the lower part and the cover part of the switch is not required, but can however nevertheless be provided in order to ensure a reliable sealing of the switch. The insulating foil then only has to be provided between the lower side of the cover part and the shoulder of the lower part, and does not have to extend up to the upper side of the cover part. It can thus be formed as an insulating ring that lies on the shoulder in the lower part.

Since the cover part preferably consists of electrically insulating material, the insulating foil may be entirely omitted. The cover part thus preferably lies with its lower side directly on the shoulder, and the first cutting burr penetrates from the lower side into the cover part.

In this way, a very simply constructed switch with few components is created, which is nevertheless securely sealed. This method of construction is particularly suitable when the cover part consists of a plastic material which is sufficiently soft for the cutting burr to penetrate into the material of the cover part.

According to a refinement, the first cutting burr comprises a cutting edge that cuts into the cover part. This cutting edge preferably penetrates directly into the material of a cover part.

In a refinement, a second circumferential cutting burr, preferably circumferentially closed in itself, is arranged on the lower side of the cover part.

It is advantageous here that a further mechanical barrier is created between the lower part and the cover part.

The first cutting burr and the second cutting burr may protrude above the shoulder or the lower side to a height of between 10 μm and 50 μm, preferably between 20 and 30 μm.

This height has been found appropriate, since the insulating foils typically used have a thickness in a range below 100 μm, so that the cutting burrs penetrate to a maximum of half of this depth into the insulating foil, so that the electrical insulation effect of the insulating foil is retained.

At their base, the cutting burrs have a width that is between 70% and 120% of the height.

According to a refinement, the switch may comprise a covering foil that lies on the upper side of the cover part, while the covering foil extends preferably to below the edge region of the insulating foil.

If the covering foil is used alone, it is employed with switches where the cover part usually does not consist of metal, but of an electrically insulating plastic or of a PTC material. The covering foil then acts on the one hand to provide mechanical protection to the cover part, and on the other hand, also, for the sealing between the folded wall and the upper side of the cover part. This sealing supplements the sealing created by the cutting burr according to the invention between the shoulder in the lower part and the cover part.

If the covering foil is used in addition to the insulating foil, this ensures particularly good sealing of the new switch.

The result of all these measures is according to one object that the new switch is very well protected against the ingress of contamination into the interior of the housing.

The insulating foil (if any) may consist of polyimide, preferably of aromatic polyimides, and the covering foil may consist of aramid paper.

Protective foils of this sort are known from the prior art, and are marketed, for example, under the trade names of Kapton® or Nomex®.

Insulating foils of these materials are characterized in that they are "stretchable", and so stretch somewhat when the cover part is inserted into the lower part, and that nevertheless they can be effectively turned over the front side of the cover part onto its upper side, wherein, furthermore, the necessary dielectric strength is achieved.

According to a refinement, the second external contact surface is arranged on the upper side of the cover part, and the switching mechanism includes a current transfer member that interacts with two stationary counter-contacts that are arranged on the underside of the cover part, of which each one interacts with one of the two external contact surfaces arranged on the upper side.

It is advantageous here that the new switch can also be designed for switching and carrying very high currents, for which purpose the two stationary counter-contacts interact with a current transfer member in the form of a contact bridge or a contact plate, so that the operating current of the device to be protected does not flow through the snap-action spring disk, or even the bimetal snap-action disk, but only through the current transfer member.

According to a further refinement, the switching mechanism comprises a bimetal part.

The bimetal part can here be a round, preferably circular bimetal snap-action disk, and it is also possible to use an elongated bimetal spring clamped at one end as the bimetal piece. In simple switches, this bimetal can also be used to carry current.

According to a further refinement, the switching mechanism also comprises a snap-action spring disk.

This snap-action spring disk can, for example, carry the movable contact part, and can carry the current through the closed switch and provide the contact pressure when in the closed state. In this way the bimetal part is relieved both of carrying the current and also of the mechanical stress in the closed state.

If the switching mechanism comprises a current transfer member that interacts with two stationary counter-contacts, it is again possible either for only one bimetal part to be provided, which then generates the closing pressure and performs the opening function, or, additionally, a spring part can be provided that applies the closing force, so that the bimetal part is only mechanically stressed when it opens the switch.

The present invention is particularly suitable for at least approximately round temperature-depended switches, which thus, when viewing the lower part or the cover part from above, are round, circular or oval, while the invention can use other housing shapes if a closed-perimeter cutting burr can be realized on the shoulder in the lower part on which the cover part lies.

Further features and advantages emerge from the description and the appended drawing.

It is clear that the features referred to above and yet to be explained below can be used not only in the respective given combinations, but also in other combinations or alone without leaving the scope of the present invention.

BRIEF DESCRIPTION OF THE DRAWINGS

Embodiments of the invention are represented in the drawing, and are explained in more detail in the description below. Here.

DESCRIPTION OF PREFERRED EMBODIMENTS

Figure 1:
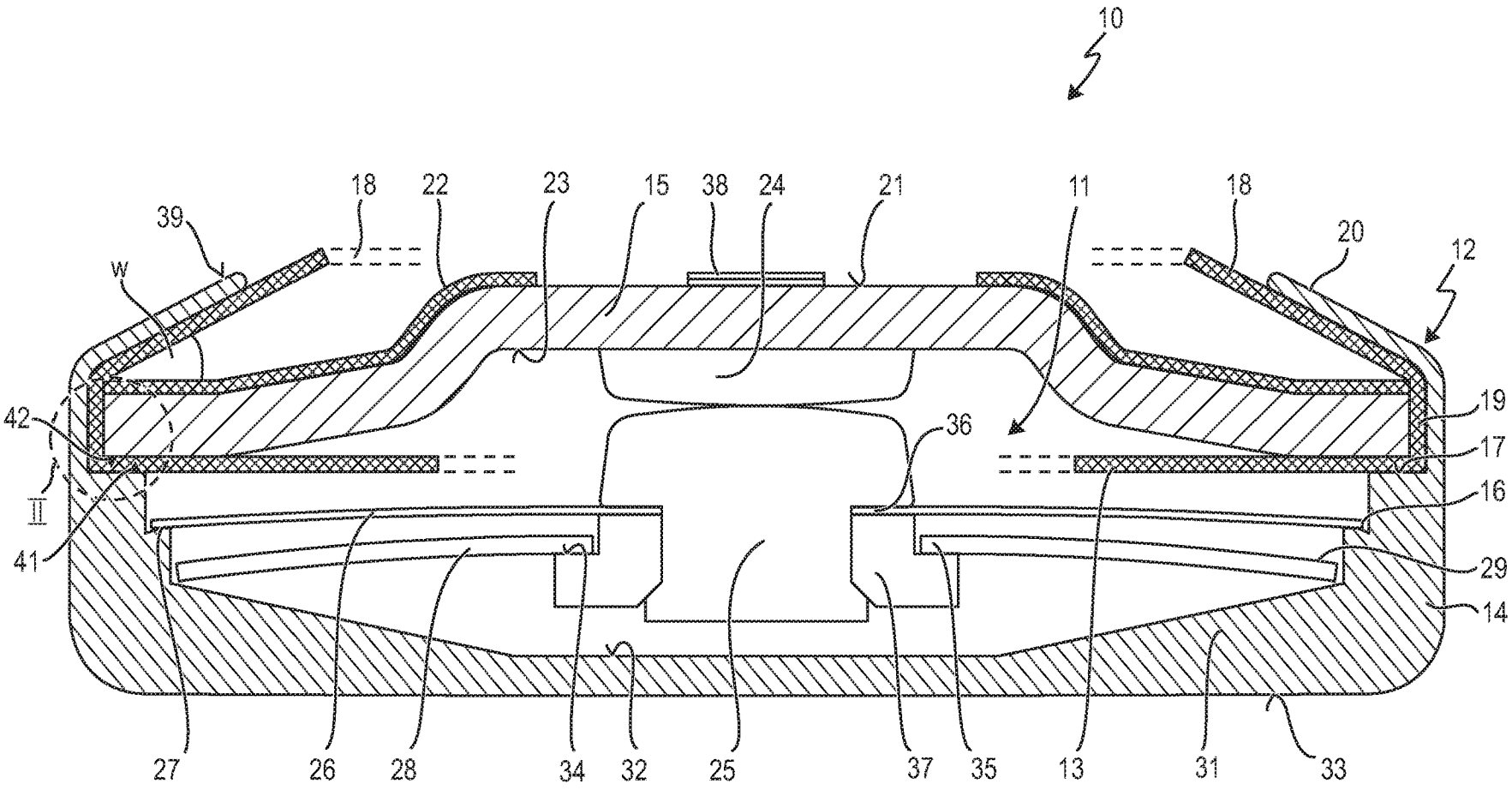
FIG. 1 shows a schematic sectional view from the side of a new temperature-dependent switch.

FIG. 1 shows a schematic side section, not true to scale, of a temperature-dependent switch 10 which is circular when viewed from above.

The switch 10 comprises a temperature-dependent switching mechanism 11 that is arranged in a housing 12, in which an insulating foil 13 is arranged which extends between a pot-like, electrically conductive lower part 14 and an electrically conductive cover part 15 that closes the lower part 14.

A circumferential lower shoulder 16 and a circumferential upper shoulder 17 are provided in the lower part 14, on which upper shoulder the cover part 15 lies, with the insulating foil 13 placed between, the edge region 18 of which foil extends to the upper side 21 of the cover part 15.

The lower part 14 comprises a circumferential wall 19, whose upper section 20 overlaps the cover part 15. The upper section 20 is folded radially inwards in such a way that, by way of the intermediate insulating foil 13, it presses the cover part 15 onto the circumferential shoulder 17 if, compared to the situation shown schematically in FIG. 1, it is folded further onto the upper side 21.

In the embodiment illustrated, the lower part 14 and the cover part 15 are made of electrically conductive material, for which reason the insulating foil 13 is provided; it runs around the cover part 15 and extends inside the housing 12 parallel to the cover part 15, is brought upwards to the side between the wall 19 and the cover part 15, and faces upward with its edge region 18.

The upper section 20 of the wall 19 thus lies flat on the edge region 18 of the insulating foil 13, and presses this in the direction of the upper side 21 of the cover part 14.

A further insulating cover 22 is provided on the upper side 21 of the cover part 15, extending radially outwards to the edge region 18 of the insulating foil 13.

A stationary counter-contact 24 is arranged on the lower side 23 of the cover part 15, and interacts with a movable contact part 25 carried by the switching mechanism 11.

The switching mechanism 11 comprises a snap-action spring disk 26 which is supported by its edge 27 on the lower shoulder 16, making an electrically conductive connection there.

A bimetal snap-action disk 28, which has two geometrical temperature positions, the low-temperature position illustrated in FIG. 1 and a high-temperature position, not illustrated, is provided underneath the snap-action spring disk 26, that is to say on its side that faces away from the stationary counter-contact 24.

The bimetal snap-action disk 28 lies with its edge 29 freely above a wedge-shaped circumferential shoulder 31, which is formed on an inner floor 32 of the lower part 14.

The lower part 14 has an external floor 33 with which thermal contact is established to a device that is to be protected.

The bimetal snap-action disk 28 is supported by its center 35 on a circumferential shoulder 34 of the contact part 25.

The snap-action spring disk 26 is connected through its inner region 36 at its center permanently to the movable contact part 25, for which purpose a ring 37, on which the shoulder 34 is formed, is pressed onto its stud 30 which protrudes through the two snap-action disks 26 and 28.

The stationary counter-contact 24, which is connected in an electrically conductive manner to the upper side 21 of the cover part 15, interacts with the movable contact part 25 and, through that, with the inner region 36 of the snap-action spring disk 26, which, in the closed state of the switch 10 illustrated in FIG. 1, is in continuous electrical contact with the shoulder 16 and, through this, with the lower part 14.

The upper side 21 acts as the first external contact surface 38, as is indicated by an area of lengthways stripes. The external floor 33 of the lower part 14 can act as the second external contact surface of the switch 10, while it is provided with the switch 10 that the upper section 20 of the wall 19 is used as the second external contact surface 39.

In the closed switch position of the switch 10 shown in FIG. 1, the movable contact part 25 is pressed by the snap-action spring disk 26 against the stationary counter-contact 24. Since the edge 27 of the electrically conductive snap-action spring disk 26 is in contact with the lower part 14, an electrically conductive connection is established between the two external contact surfaces 38, 39.

When the temperature inside the switch 10 now increases beyond the response temperature of the bimetal snap-action disk 28 it flips from the convex configuration shown in FIG. 1 into a concave configuration in which its edge 29 in FIG. 1 moves upwards, so that it moves from below to rest against the edge 27 of the snap-action spring disk 26.

The bimetal snap-action disk 28 now presses with its center 35 on the shoulder 34, and thus lifts the movable contact part 25 from the stationary counter-contact 24.

The snap-action spring disk 26 can be a bi-stable spring disk which is also geometrically stable when the switch is in its open position, so that the movable contact part 25 then does not come to rest against the stationary counter-contact 24 when the edge 29 of the bimetal snap-action disk 28 no longer presses against the edge 27 of the snap-action spring disk 26.

If the temperature inside the switch 10 now falls again, then the edge 29 of the bimetal snap-action disk 26 moves downwards, and comes to rest against the wedge-shaped shoulder 31. The bimetal snap-action disk 26 now presses with its center 35 from below against the snap-action spring disk 26, and pushes this back into its other geometrically stable position, in which, as in FIG. 1, the movable contact part 25 presses against the stationary counter-contact 24.

In the present embodiment, the switching mechanism 11 comprises, in addition to the bimetal snap-action disk 28, the current-carrying snap-action spring disk 26, while it is also possible for the switching mechanism 11 only to be provided with the bimetal snap-action disk 28, which then would lie with its edge 29 against the shoulder 16 and would carry current.

It is also possible for the bimetal snap-action disk 28 to be arranged above the snap-action spring disk 26.

Figure 2:
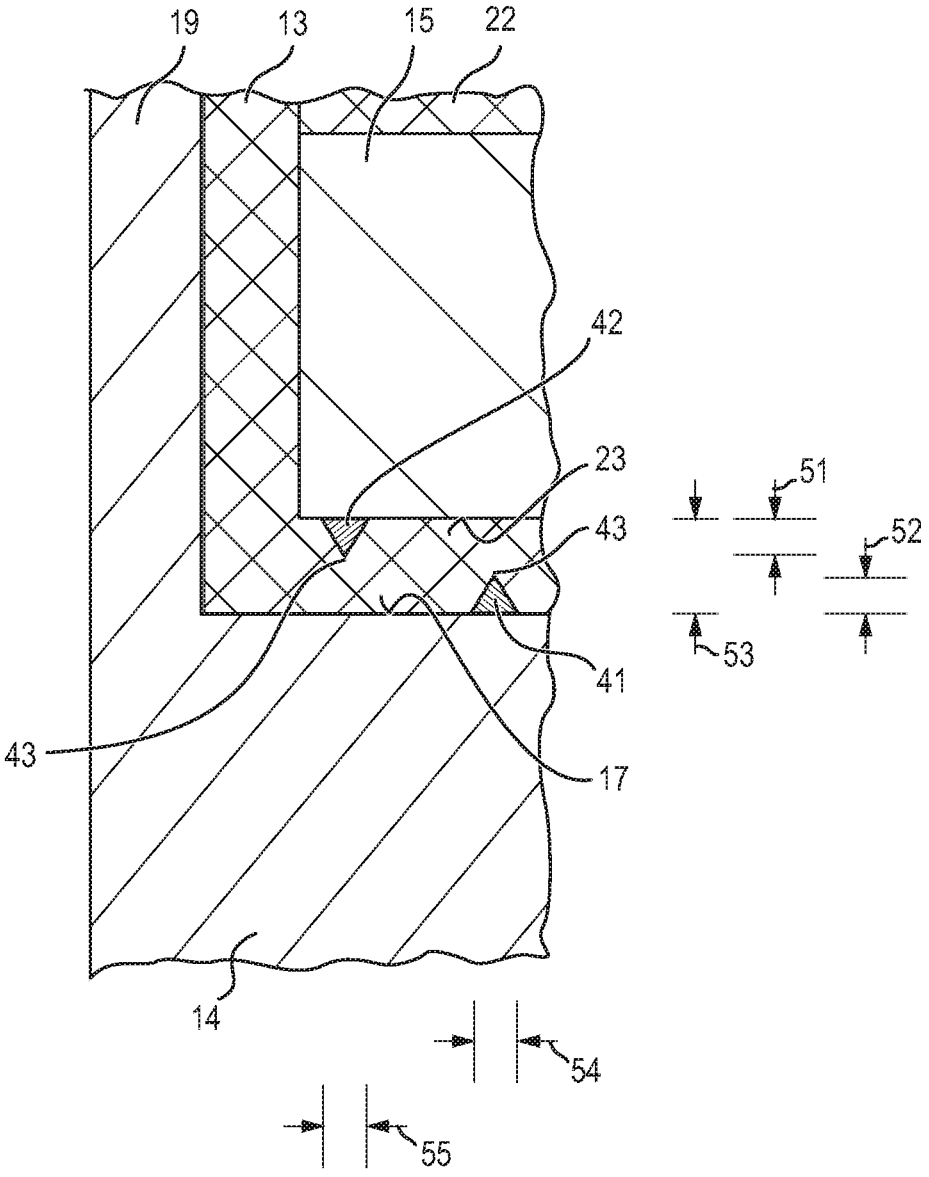
FIG. 2 shows a schematic, enlarged view of the detail II of FIG. 1.

The detail II of the switch 10 from FIG. 1 is shown enlarged in FIG. 2.

The region of the switch 10 from FIG. 1 is shown enlarged in FIG. 2, where the cover part 15 lies on the shoulder 17 with the insulating foil 13 in between.

A cutting burr 41 is provided radially inwards on the shoulder 17, which protrudes perpendicularly in the direction of the cover part 15 above the shoulder 17, and has penetrated about one third of the way into the insulating foil 13.

A further cutting burr 42 is provided on the lower side 23 of the cover part 15 radially outside, extending perpendicularly above the lower side 23 in the direction of the lower part 14, and also penetrating about one third of the way into the insulating foil 13.

The two cutting burrs 41 and 42 have an upper cutting edge 43, and have an approximately triangular form in their cross-section.

The two cutting burrs 41 and 42 are closed in itself and run radially around, so that each forms an annular cutting burr 41 or 42, each of which comprises an upward-facing annular cutting edge 43.

The cutting burr 42 has a height above the lower side 43 of about 30 μm, indicated by 51. The cutting burr 41 also has a height 52 protruding beyond the shoulder 17, which is also about 30 μm. The insulating foil 13 has a thickness, indicated by 53, that is about 100 μm.

At their base, where they are formed integrally with the shoulder 17 or the lower side 23 respectively, the cutting burrs 41 and 42 respectively have a width indicated by 54 and 55 respectively that corresponds approximately to the height 52 or 51 respectively.

The two cutting burrs 41 and 42 each form a mechanical barrier to the possible ingress of contamination, in particular liquids, that could penetrate between the insulating foil 13 and either the cover part 15 or the lower part 14 into the interior of the switch.

Since the two cutting burrs 41 and 42 are closed in itself, they form a complete mechanical barrier that cannot be passed by contamination, in particular liquids.

Figure 3:
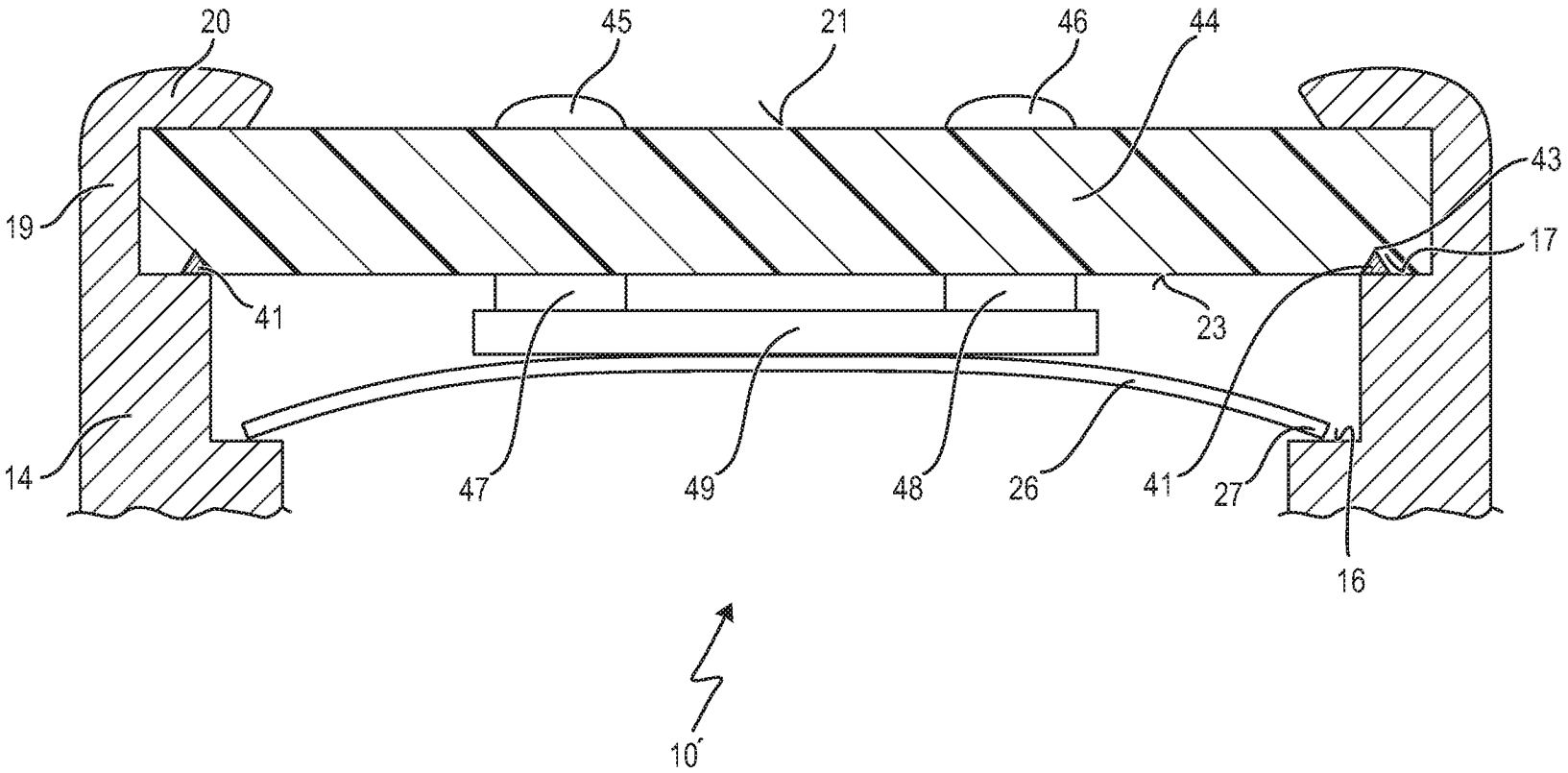
FIG. 3 shows a schematic, partly sectional partial view from the side of a further, new temperature-dependent switch.

Whereas in FIG. 2 both the cover part 15 and the lower part 14 consist of electrically conductive material, and therefore have to be insulated from one another by the insulating foil 13, FIG. 3 shows, in principle, a sectional view of part of the upper region of a switch 10' in which the lower part 14 again consists of metal, but in which however a cover part 44 consisting of plastic is provided.

The cover part 44 rests with its lower side 23 directly on the shoulder 17 in the lower part 14; the shoulder 17 is again provided with the cutting burr 41 already known from FIG. 2, the upper cutting edge 43 of which has cut into the material of the cover part 14.

The cover part 44 is being held on shoulder 17 by the folded upper section 20 of the circumferential wall. During assembly of the new switch 10', the cutting burr 41 penetrates into the material of the cover part 44, and forms a mechanical barrier against the penetration of liquids between the cover part 44 and the lower part 14.

The cutting burr 41 of the embodiment according to FIG. 3 again is closed in itself. Whereas the cutting burr 41 in FIG. 3 lies radially inwards on the shoulder 17, it can here also be arranged centrally or radially to the outside.

It is also to be mentioned that the shape of the cutting burrs 41 and 42 is adapted to the material into which they are to penetrate.

Whereas in the switch 10 from FIG. 1, an external contact surface 38 is arranged on the upper side 21 of the cover, and the other external contact surface 39 is formed on the wall 19, the switch 10' of FIG. 3 comprises two external contact surfaces 45, 46 which are both arranged next to one another on the upper side 21 of the cover part 44.

The two external contact surfaces 45 and 46 are each joined to stationary counter-contacts 47 and 48 which are arranged on the lower side 23 of the cover part 44 and which interact with a current transfer member 49 that is pressed by a snap-action spring disk 26 against the stationary counter contacts 47, 48.

In the switch 10', the operating current thus does not flow through the snap-action spring disk 26, but through the current-transfer member 49.

In the closed state of the switch 10' shown in FIG. 3, the snap-action spring disk 26 is supported by its edge 27 on the lower shoulder 16 in the lower part 14, and presses the current transfer member 49 against the two stationary counter-contacts 47, 48.

What is claimed is:

1. A temperature-dependent switch, comprising:

a housing comprising an electrically conductive lower part and a cover part made of an electrically insulating material, wherein the cover part has a lower side and an upper side, wherein the lower part has a circumferential shoulder and a circumferential wall, wherein the cover part lies with its lower side on the circumferential shoulder, and wherein the circumferential wall of the lower part has an upper section overlapping the cover part and pressing the cover part onto the circumferential shoulder, at least one first external contact surface being arranged on the upper side of the cover part, at least one second external contact surface being provided externally on the housing, a temperature-dependent switching mechanism being arranged in the housing, wherein the switching mechanism, depending on its temperature, establishes or opens an electrically conductive connection between the at least one first external contact surface and the at least one second external contact surface, and a first sharp-edged cutting burr being arranged on the circumferential shoulder in the lower part, wherein the first sharp-edged cutting burr is configured to form a mechanical barrier between the cover part and the lower part by the first sharp-edged cutting burr cutting into the lower side of the cover part.

2. The switch of claim 1, wherein the first sharp-edged cutting burr is circumferentially closed in itself.

3. The switch of claim 1, wherein the first sharp-edged cutting burr is formed integrally with the circumferential shoulder in the lower part.

4. The switch of claim 1, wherein the first sharp-edged cutting burr comprises a cutting edge configured to cut into the lower side of the cover part.

5. The switch of claim 1, wherein the electrically insulating material is a plastic material.

6. The switch of claim 1, wherein a second sharp-edged cutting burr is arranged on the lower side of the cover part.

7. The switch of claim 6, wherein the second sharp-edged cutting burr is circumferentially closed in itself.

8. The switch of claim 7, wherein the second sharp-edged cutting burr is radially spaced from the first sharp-edged cutting burr.

9. The switch of claim 6, wherein the second sharp-edged cutting burr protrudes from the lower side to a height of between 10 μm and 50 μm.

10. The switch of claim 1, wherein the first sharp-edged cutting burr protrudes above the circumferential shoulder to a height of between 10 μm and 50 μm.

11. The switch of claim 1, wherein the at least one second external contact surface is arranged on the upper side of the cover part.

12. The switch of claim 1, wherein the switching mechanism carries a current transfer member configured to interact with a first stationary counter contact and a second stationary counter contact arranged on the lower side of the cover part, wherein the first stationary counter contact is connected to the at least one first external contact surface, and wherein the second stationary counter contact is connected to the at least one second external contact surface.

13. The switch of claim 1, wherein the switching mechanism comprises a bimetal part.

14. The switch of claim 1, wherein the switching mechanism comprises a snap-action spring disk.

15. The switch of claim 1, wherein the first sharp-edged cutting burr (i) is circumferentially closed in itself, (ii) is formed integrally with the circumferential shoulder in the lower part and (iii) is a turned part created together with the lower part by turning.

16. The switch of claim 1, wherein the first sharp-edged cutting burr protrudes from a top surface of the circumferential shoulder in the lower part in a direction toward the upper section of the lower part.

* * * * *